US008977180B2

(12) United States Patent
Akuta

(10) Patent No.: US 8,977,180 B2
(45) Date of Patent: Mar. 10, 2015

(54) FIXING DEVICE, AND IMAGE FORMING APPARATUS

(71) Applicant: Fuji Xerox Co., Ltd., Tokyo (JP)

(72) Inventor: Tomokazu Akuta, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 13/859,191

(22) Filed: Apr. 9, 2013

(65) Prior Publication Data

US 2014/0140743 A1 May 22, 2014

(30) Foreign Application Priority Data

Nov. 20, 2012 (JP) ..... 2012-254143

(51) Int. Cl.
*G03G 15/20* (2006.01)

(52) U.S. Cl.
CPC ..... *G03G 15/2007* (2013.01)
USPC ..... 399/336; 399/122; 399/320; 430/97

(58) Field of Classification Search
CPC ..... G03G 15/2007; G03G 15/201
USPC ..... 399/122, 320, 335, 336; 430/97, 109.1
See application file for complete search history.

(56) References Cited

U.S. PATENT DOCUMENTS

2011/0222935 A1* 9/2011 Egusa et al. ..... 399/336

FOREIGN PATENT DOCUMENTS

JP 2011-191426 9/2011

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A fixing device includes a curved member that supports a recording medium on which an image is formed by an image forming material that absorbs light and is fixed, and an irradiating portion that irradiates the curved member with light from the recording medium side, wherein the light axis of the light does not intersect with a center axis of the curved member, and is substantially perpendicular to a tangential line in a middle point in a transporting direction of the recording medium in a region of the curved member supporting the recording medium.

6 Claims, 8 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2012-254143 filed Nov. 20, 2012.

BACKGROUND (i) Technical Field

The present invention relates to a fixing device, and an image forming apparatus.

(ii) Related Art

A fixing device is known in which a laser light irradiates a recording medium on which a toner image is formed and the toner is fixed on the recording medium.

SUMMARY

According to an aspect of the invention, there is provided a fixing device including: a curved member that supports a recording medium on which an image is formed by an image forming material that absorbs light and is fixed; and an irradiating portion that irradiates the curved member with light from the recording medium side, wherein the light axis of the light does not intersect with a center axis of the curved member, and is substantially perpendicular to a tangential line in a middle point in a transporting direction of the recording medium in a region of the curved member supporting the recording medium.

BRIEF DESCRIPTION OF THE DRAWINGS

Exemplary embodiments of the present invention will be described in detail based on the following figures, wherein.

DETAILED DESCRIPTION

Figure 1:
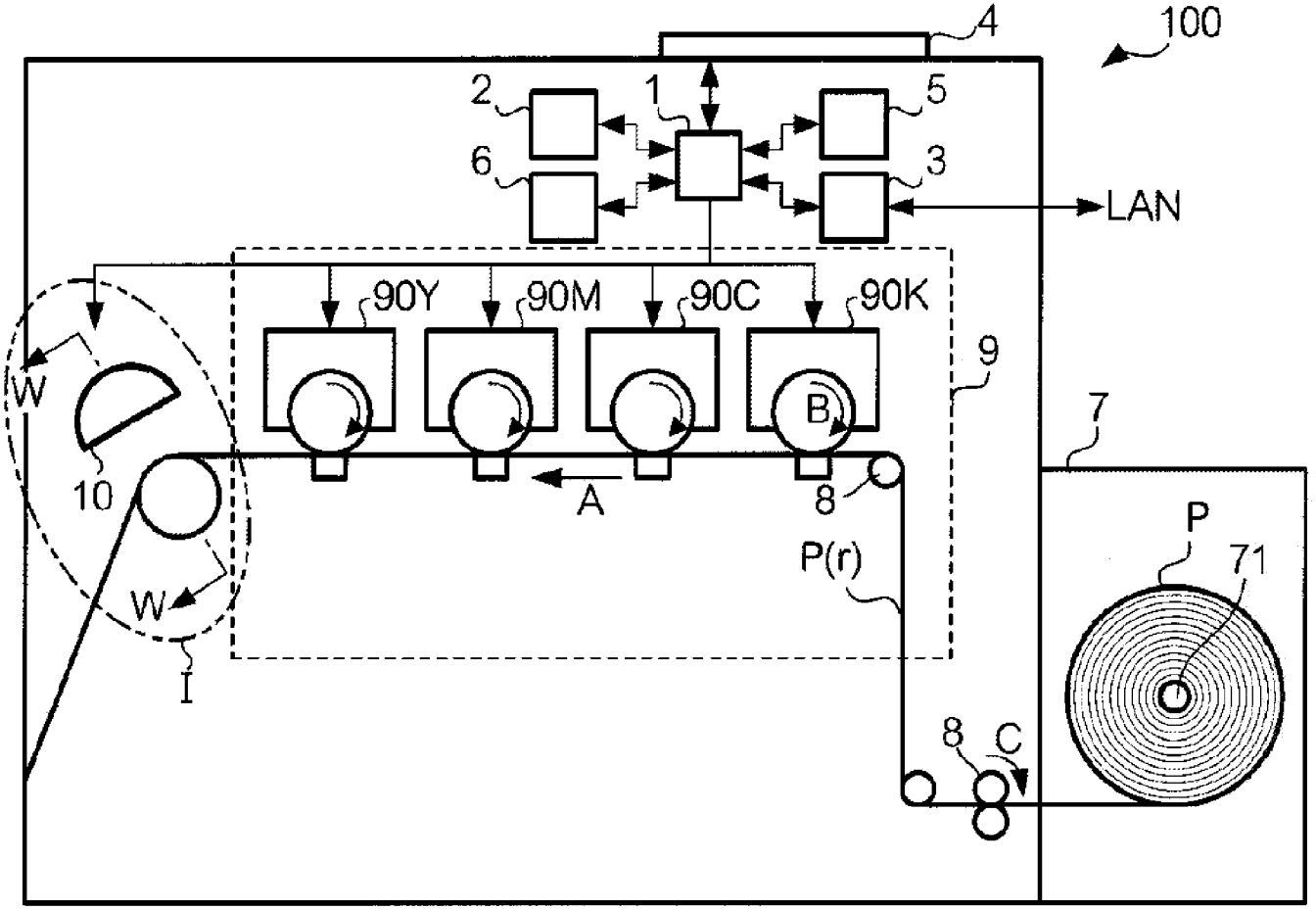
FIG. 1 is a schematic view showing a hardware configuration of an image forming apparatus.

FIG. 1 is a schematic view showing a hardware configuration of an image forming apparatus 100 according to an exemplary embodiment of the invention. The image forming apparatus 100 includes a controller 1, a memory 2, a communication portion 3, a receiving portion 4, an imaging reading portion 5, an image processing portion 6, a storing portion 7, a transport roll 8, an image forming portion 9, and a fixing device 10 in the inner portion of a housing. The controller 1 controls an operation of each portion of the image forming apparatus 100. The controller 1 includes a CPU (Central Processing Unit), a ROM (Read Only Memory), and a RAM (Random Access Memory). The memory 2 includes a device that stores data and programs used by the controller 1, for example, an HDD (Hard Disk Drive). The communication portion 3 is connected to an external device such as a personal computer or a facsimile machine, and sends and receives image data. The receiving portion 4 receives an input of an instruction from a user. The receiving portion 4 includes an operational unit by which the user inputs the instruction to the image forming apparatus 100. The instruction received through the receiving portion 4 is sent to the controller 1, and the controller 1 controls the operation of the image forming apparatus 100 in accordance with the instruction. The image reading portion 5 optically reads a document and generates image signals. Specifically, the image reading portion 5 includes a platen glass, a light source, an optical system, and an image device (all not shown). The light source irradiates the light with respect to the document placed on the platen glass, the light reflected by the document is split into red, green, and blue via the optical system, and the split light is incident to the image device. The imaging device converts the incident light into image signals, and the image signals are supplied to the image processing portion 6. The image processing portion 6 performs an A/D conversion on the image signals that is supplied from the image reading portion 5, a noise reduction, a gamma correction, a conversion of a color space (from R, G, and B to Y (Yellow), M (Magenta), C (Cyan), and K (Black)), a screen processing, and the like. In this way, the image data representing gradations of every color and every pixel are generated.

The storing portion 7 stores sheet-like paper P. The paper P is a continuous paper (referred to as "continuous form" or "continuous form paper") that is not cut into single pages, and is stored in a state of being wound around a shaft 71. In addition, when the paper P is divided at perforations for each page, the storing portion 7 may be configured so that the paper is stored in a state of being folded in a zigzag manner along the perforated surfaces. The transport roll 8 (an example of a transport member) transports the paper P along a transport path r. In addition to the shown one, plural transport rolls 8 are provided on the transport path r. The image forming portion 9 (an example of the transfer portion) includes image forming processing units 90Y, 90M, 90C, and 90K. The image forming processing units 90Y, 90M, 90C, and 90K repeatedly transfer the toner image of each of yellow, magenta, cyan, and black to the surface of the paper P according to an electrographic method based on the image data supplied from the image processing portion 6. Hereinafter, the surface of the paper P to which the toner image is transferred is referred to as a "front surface" and the surface to which the toner image is not transferred is referred to as a "rear surface". Since the configuration of each of the image forming processing units is common, hereinafter, when it is not necessary to distinguish each of the image forming processing units, the image forming processing units are collectively referred to as the image forming processing unit 90. In addition, also with respect to the component of the image forming processing unit 90, the notation such as Y, M, C, and K is omitted. The fixing device 10 fixes the toner image transferred by the image forming portion 9 to the paper P. The paper P on which the toner image is fixed is discharged to the outside of the image forming apparatus 100. For example, the discharged paper P is cut for each page by a cutting device (not shown). Hereinafter, the direction (direction of an arrow A) in which the paper P is transported is simply referred to as a "transporting direction" (an example of a first direction), and a direction (direction perpendicular to a paper surface of FIG. 1) perpendicular to the transporting direction is referred to as a "width direction"

Figure 2:
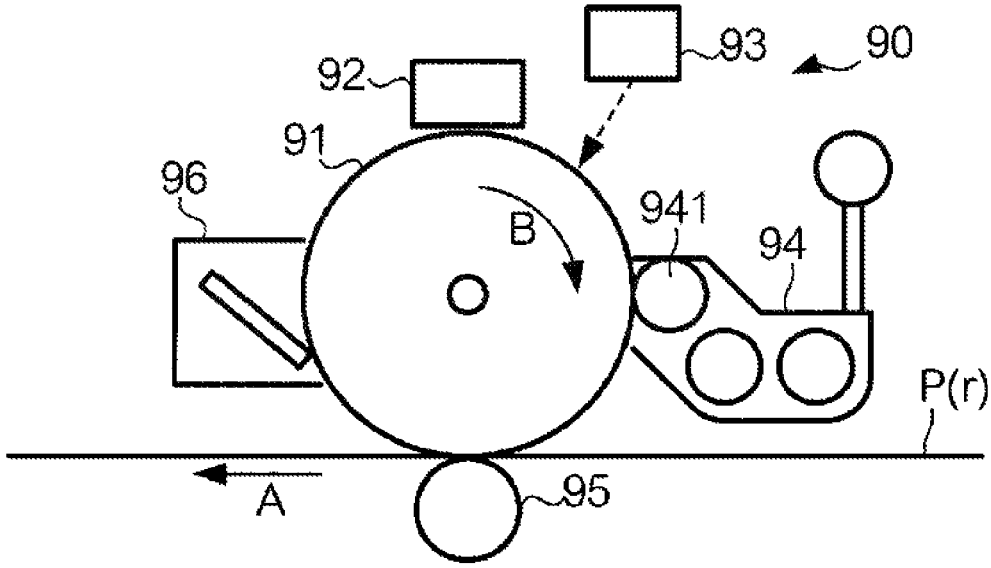
FIG. 2 is a schematic view of an image forming processing unit when viewed from one side in a width direction.

FIG. 2 is a schematic view of the image forming processing unit 90 when viewed from one side in the width direction. The image forming processing unit 90 includes a photoconductor drum 91, a charging device 92, an exposure device 93, a developing device 94, a transfer device 95, and a cleaner 96. The photoconductor drum 91 is a cylindrical member in which a photoconductor film is laminated around the outer circumferential surface thereof, and is supported so as to rotate in a direction of an arrow B with the center of the cylinder as an axis. For example, the charging device 92 may be a scorotron charger and charge the photoconductive film of the photoconductor drum 91 to a potential which is predetermined. The exposure device 93 exposes the photoconductor drum 91 charged by the charging device 92 and forms an electrostatic latent image. Specifically, laser light corresponding to the gradation of each pixel representing the image data, which are supplied from the image processing portion 6, is generated, and the laser light scans the photoconductive film of the photoconductor drum 91 in the width direction. The photoconductor drum 91 rotates in the direction of the arrow B, and writing of the electrostatic latent image at a scan line unit in the width direction is repeated in the transporting direction.

The developing device 94 develops the electrostatic latent image formed on the photoconductor drum 91. The developing device 94 includes a development roller 941 that is provided so as to be opposite to the outer circumferential surface of the photoconductor drum 91. A two-component developer including the toner and a carrier is accommodated in the inner portion of the developing device 94. The toner is one in which powder made of resin is colored with any one color material of yellow, magenta, cyan, and black. The carrier is a powder that is manufactured by a magnetic material. The two-component developer is attached to the outer circumferential surface of the development roller 941, which is driven to rotate, through a magnetic force. A developing bias having a reverse polarity to the electrostatic latent image is applied to the development roller 941. If the toner is charged so as to have a reverse polarity to the electrostatic latent image by the developing bias, the toner moves on the electrostatic latent image and the toner image is formed. The transfer device 95 is a cylindrical member that is opposite to the photoconductor drum 91 while interposing the transport path r. A transfer bias having a reverse polarity to the toner image is applied to the transfer device 95. If the paper P is charged so as to have a reverse polarity to the toner image by the transfer bias, the toner image is transferred to the paper P. If the paper P passes through the image forming processing units 90K, 90C, 90M, and 90Y, the toner image is repeatedly transferred. The cleaner 96 removes the toner remaining on the surface of the photoconductor drum 91 after the toner image is transferred.

Figure 3:
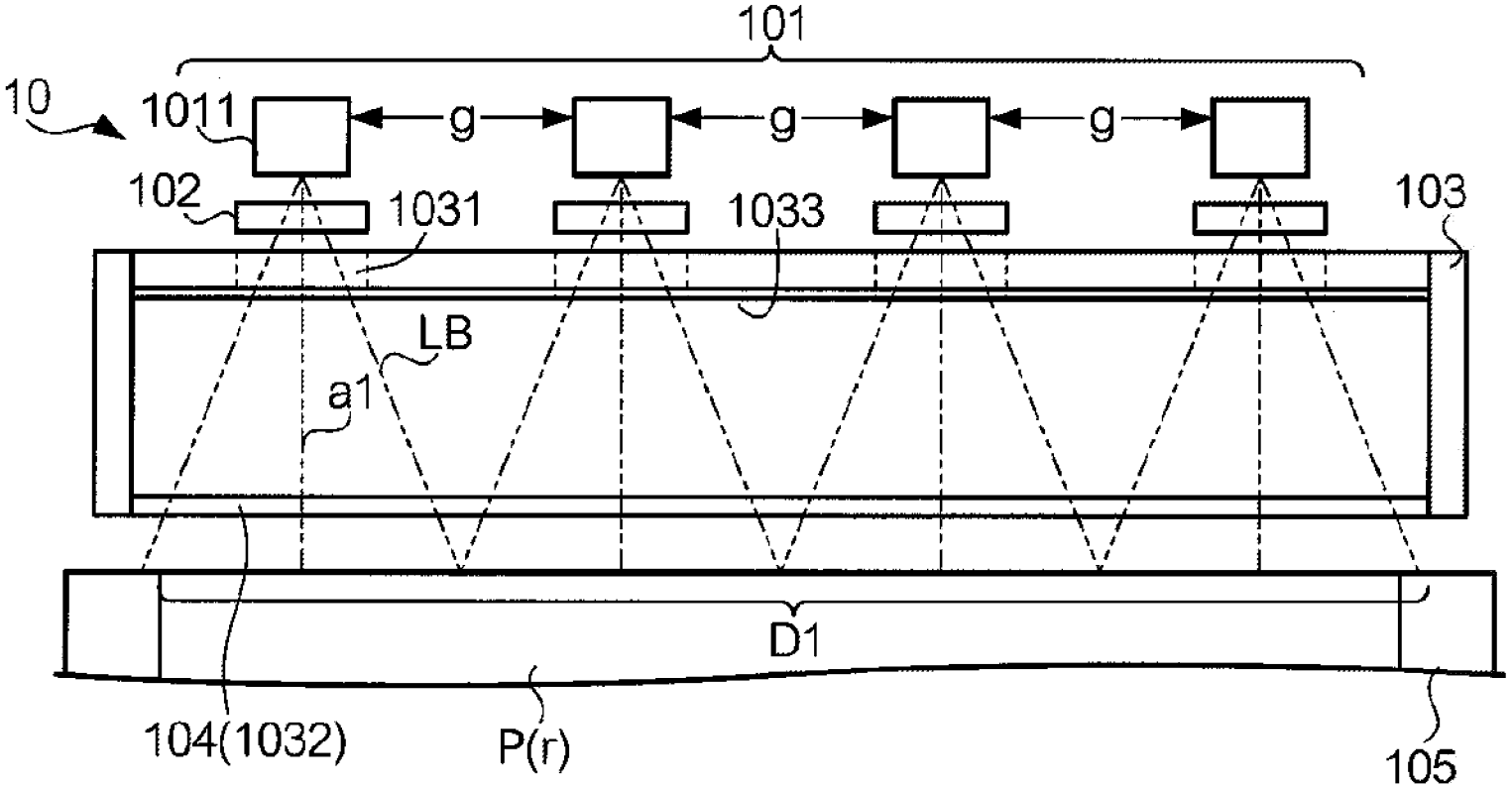
FIG. 3 is a schematic view when a fixing device according to an exemplary embodiment is taken along a W-W line.
Figure 4:
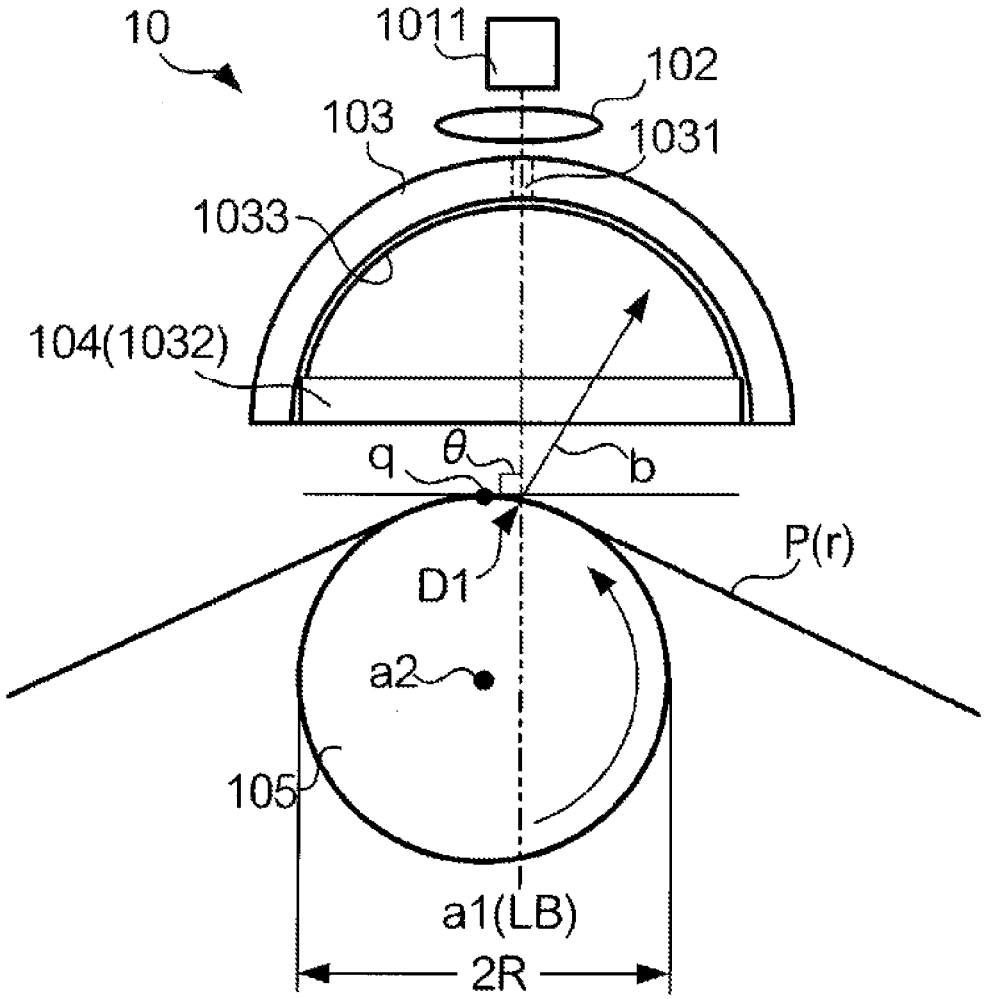
FIG. 4 is an enlarged view of an I portion in the fixing device according to the exemplary embodiment.

FIG. 3 is a schematic view when the fixing device 10 according to an exemplary embodiment of the invention is taken along a W-W line of FIG. 1. FIG. 4 is an enlarged view of an I portion shown by a two-dotted chain line of FIG. 1 in the fixing device 10. The fixing device 10 includes an irradiating portion 101, an optical member 102, a reflection member 103, a partition member 104, and a rotating body (support roller) 105.

The irradiating portion 101 (an example of a first irradiating portion) irradiates the laser light LB on the paper P that is transferred through the transport roll 8. The irradiating portion 101 includes plural light sources 1011 that generate the laser light LB. A light axis a1 is the light axis of the laser light LB. The light sources 1011 are lined up at intervals g along the width direction. The interval g is determined so that the laser light LB irradiates the entire region on which the toner image of the paper P is formed. In the example shown in FIG. 3, the irradiating portion 101 includes four light sources 1011. A wavelength of the laser light LB may be any wavelength if applying sufficient energy to melt the toner to the toner. For example, infrared ray is used for the laser light LB. In this case, toner to which a material absorbing the infrared rays is mixed is used in the developing device 94.

The optical member 102 is a member that controls a direction in which the laser light LB irradiated from the light source 1011 propagates, and for example is a lens. The optical member 102 is provided to the light source 1011 in a one-to-one correspondence. In the example of FIG. 3, four optical members 102 are provided so as to correspond to each of four light sources 1011. The laser light LB irradiated from the light sources 1011 propagates toward the optical member 102. As shown in FIG. 4, in the optical member 102, the cross-section when is viewed from the width direction is formed in an approximately convex shape, and the optical member 102 converges the laser light LB in the transporting direction. The optical member 102 converges the laser light LB so that an irradiation width in the transporting direction is within a determined range (for example, 1.0±0.1 mm). Moreover, as shown in FIG. 3, in the optical member 102, the cross-section when viewed from the transporting direction is an approximately rectangular shape, and transmits the laser light LB without refracting the laser light LB in the width direction. If the laser light LB transmits the optical member 102, the laser light propagates toward the reflection member 103.

In the reflection member 103, as shown in FIG. 3, the cross-section when viewed from the transporting direction is formed in an approximately rectangular shape, and as shown in FIG. 4, the cross-section when viewed from the width direction is formed in an approximately arch shape. The reflection member 103 includes holes 1031, an opening 1032, and a reflection surface 1033. The laser light LB that is irradiated from the light sources 1011 passes through holes 1031. The opening 1032 is opposite to the transport path r, and the laser light LB propagating the inner portion of the reflection member 103 passes through the opening 1032. The laser light LB passing through the opening 1032 is irradiated to an irradiation region D1 that extends in the width direction on the transport path r. If the laser light LB is irradiated to the paper P, the laser light LB is reflected at a region of the front surface of the paper P on which toner particles are not attached. Since not only a mirror reflection but also a diffusion reflection are generated on the surface of the paper P, reflection in all directions may be generated. Moreover, the reflected light that is reflected by the paper P passes through the opening 1032. The reflection surface 1033 is a surface that is opposite to the transport path r in the inside of the reflection member 103. The reflection surface 1033 reflects the reflected light passing through the opening 1032 to the paper P. A processing for reflecting the laser light LB is performed on the reflection surface 1033. For example, the reflection member 103 is made of a metal such as aluminum, the reflection surface 1033 may be polished to a mirror surface, and plating such as silver may be performed on the reflection surface 1033. The reflected light is reflected at the reflection surface 1033, and thus, a portion of the reflected light is absorbed by the toner particles and the remainder is reflected at the surface of the paper P again. In this way, if the reflection of the laser light LB is repeated at the surface of the paper P and the reflection surface 1033 of the reflection member 103, a portion of the laser light LB reflected at the reflection surface 1033 is absorbed by the toner and promotes the heating and melting of the toner.

A portion of the toner heated by the laser light LB is sublimated and becomes a gas, and the gas is cooled and dust may be generated. The partition member 104 partitions between the irradiation portion 101 and the transport path r so that dust does not enter a space that is surrounded by the reflection member 103. The partition member 104 is an approximately rectangular plate-shaped member that includes a short side and a long side, and is formed of a material through which light transmits, for example, quartz glass. The partition member 104 is supported by the reflection member 103 so that the short side is along the transporting direction and the long side is along the width direction in the opening 1032.

The support roller 105 that is an example of a curved member rotates about a rotational axis a2 (an example of a center axis) in the transporting direction according to the transport of the paper P by the transport roll 8, and supports the paper P. The support roller 105 is provided so that the side surface faces the opening 1032. Therefore, the laser light LB of the irradiating portion 101 is irradiated from the paper P side toward the support roller 105. In FIG. 4, the light axis a1 intersects with the support roller 105. In addition, in the example shown in FIG. 4, an angle θ, in which the light axis a1 forms a tangential line in a point q that is a center of the region of the side surface of the support roller 105 supporting the paper P, is 90°.

When the laser light LB is irradiated and fixes the toner image on the paper P, it is considered that the laser light is focused to some extent by the optical system and irradiated. In this case, since the paper P moves up and down and thus, variation in the intensity of the irradiated laser occurs, it is necessary to suppress flapping of the paper P. Here, the paper P is transported along the surface of the curved member, and it may be expected that the flapping is suppressed. However, if laser light is irradiated to the top of the curved member, the primary reflected light is returned to the light source, and thus, the light source may be damaged. In the exemplary embodiment, when the laser light is irradiated to the paper P that is transported using the curved member as described above, the primary reflected light is suppressed to be returned to the light source. Moreover, "suppressing the primary reflected light returning to the light source" does not mean that the primary reflected light is not at all returned to the light source. When the curved member or the paper P does not perform a mirror reflection, it is sufficiently expected that scattered light is returned to the light source. In the exemplary embodiment of the invention, when it is assumed that the laser light LB performs a mirror reflection on the surface of the curved member, the light source may be physically provided so as to avoid the irradiation region of the primary reflected light.

Figure 5:
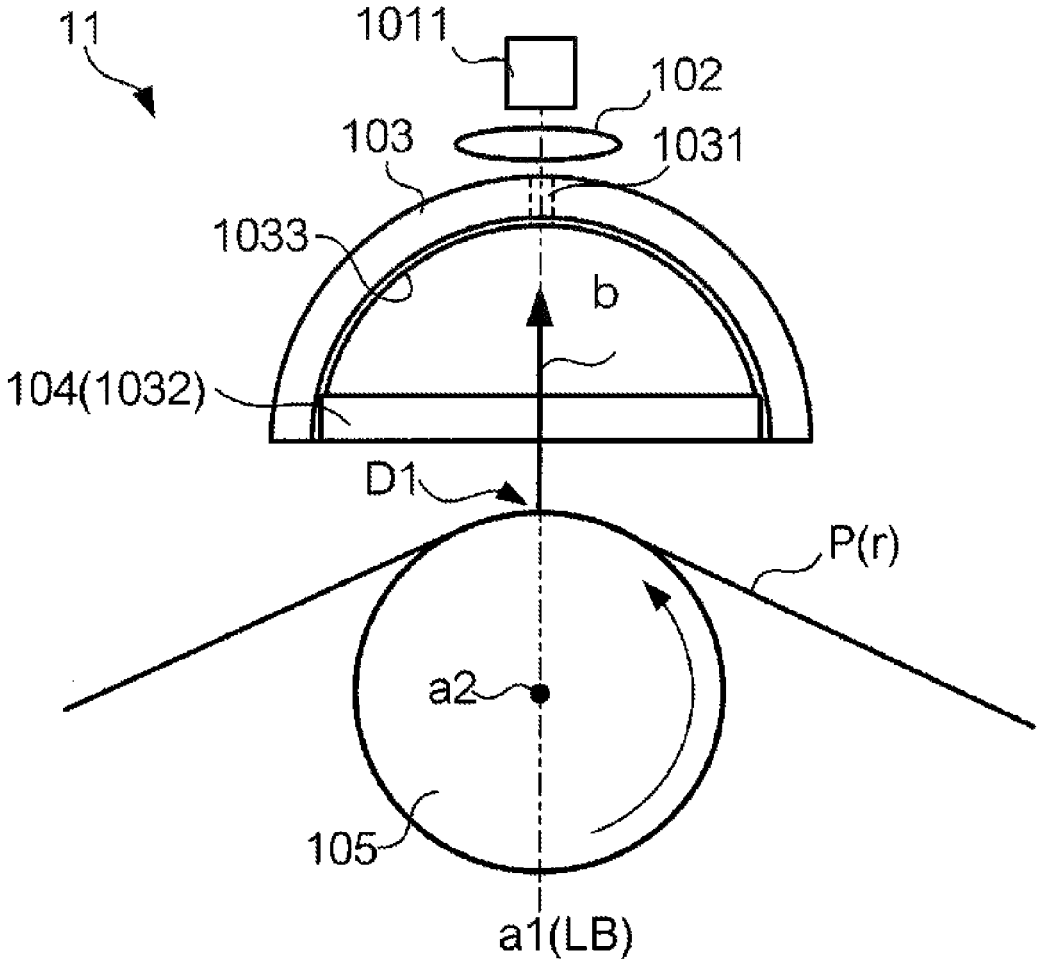
FIG. 5 is a view when a fixing device according to Comparative Example is viewed from one side in a width direction.

FIG. 5 is a view when a fixing device 11 according to Comparative Example is viewed from one side of the width direction. In Comparative Example, a light source 1011 and a support roller 105 are disposed so that the light axis a1 intersects with the rotational axis a2. "The light axis a1 and the rotational axis a2 intersecting with each other" means that a distance between the light axis a1 and the rotational axis a2 becomes less than or equal to a determined value. For example, the determined value is a value that is determined according to a diameter 2R of the support roller 105. An arrow b indicates a propagation direction of the laser light LB that is mirror-reflected in the irradiation region D1. When the light axis a1 and the rotational axis a2 intersect with each other, the laser light LB that is mirror-reflected at the surface of the paper P passes through the hole 1031 and reaches the light source 1011. In this case, the light source 1011 may be broken down.

Refer to FIG. 4 again, in the fixing device 10 according to the exemplary embodiment of the invention, the light source 1011 and the support roller 105 are disposed so that the light axis a1 does not intersect with the rotational axis a2. "The light axis a1 being not intersecting with the rotational axis a2" means that the distance between the light axis a1 and the rotational axis a2 is more than the determined value. When the light axis a1 and the rotational axis a2 do not intersect with each other, the laser light LB that is mirror-reflected at the irradiation region D1 reaches the reflection surface 1033 without passing through the hole 1031. Therefore, compared to the case where the light axis a1 intersects with the rotational axis a2, the possibility that the light source 1011 may be broken down by the laser light LB reflected at the irradiation region D1 is suppressed.

Figure 6:
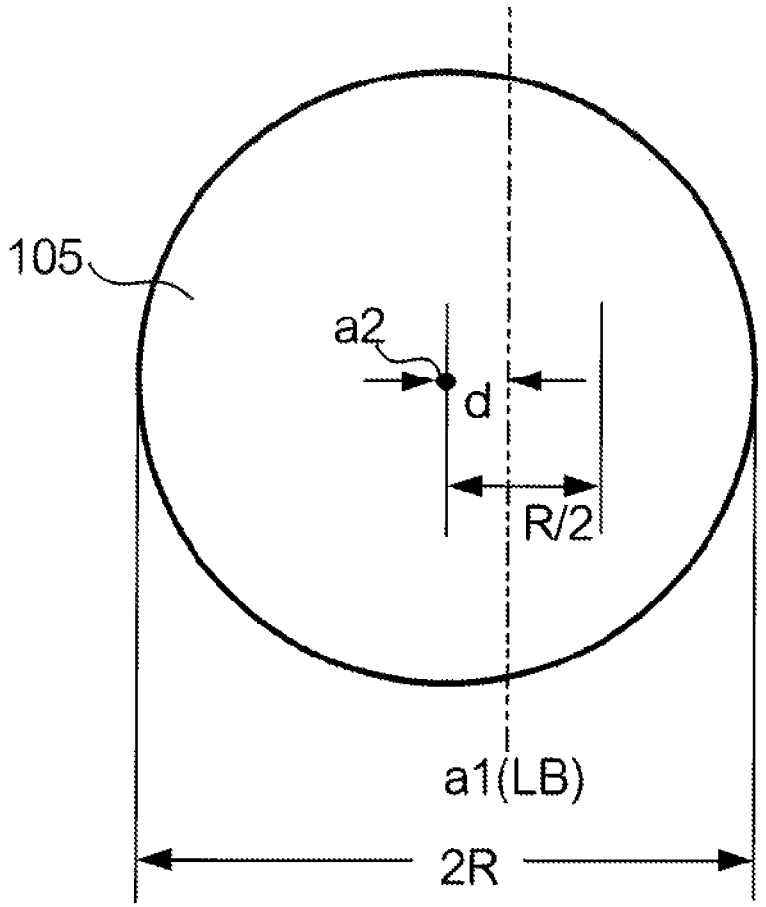
FIG. 6 is a view showing a distance between a light axis and a rotational axis.

FIG. 6 is a view showing the distance d between the light axis a1 and the rotational axis a2 in the fixing device 10. In the fixing device 10, for example, the light source 1011 and the support roller 105 are disposed so that the distance d between the light axis a1 and the rotational axis a2 is less than or equal to ¼ (R/2) of a diameter (here, the diameter 2R of the support roller 105) that perpendicularly crosses the light axis a1 of the support roller 105.

Modification

The present invention is not limited to the above-described exemplary embodiment, and various modifications may be performed. Hereinafter, some modifications will be described. Among the modifications described below, two or more may be combined and be used. In addition, a first modification and a second modification are not included in the present invention.

(1) First Modification

The angle θ, in which the light axis a1 forms a tangential line in the point q of the side surface of the support roller 105, is not limited to the case of 90°. The angle θ may be less than 90°.

Figure 7:
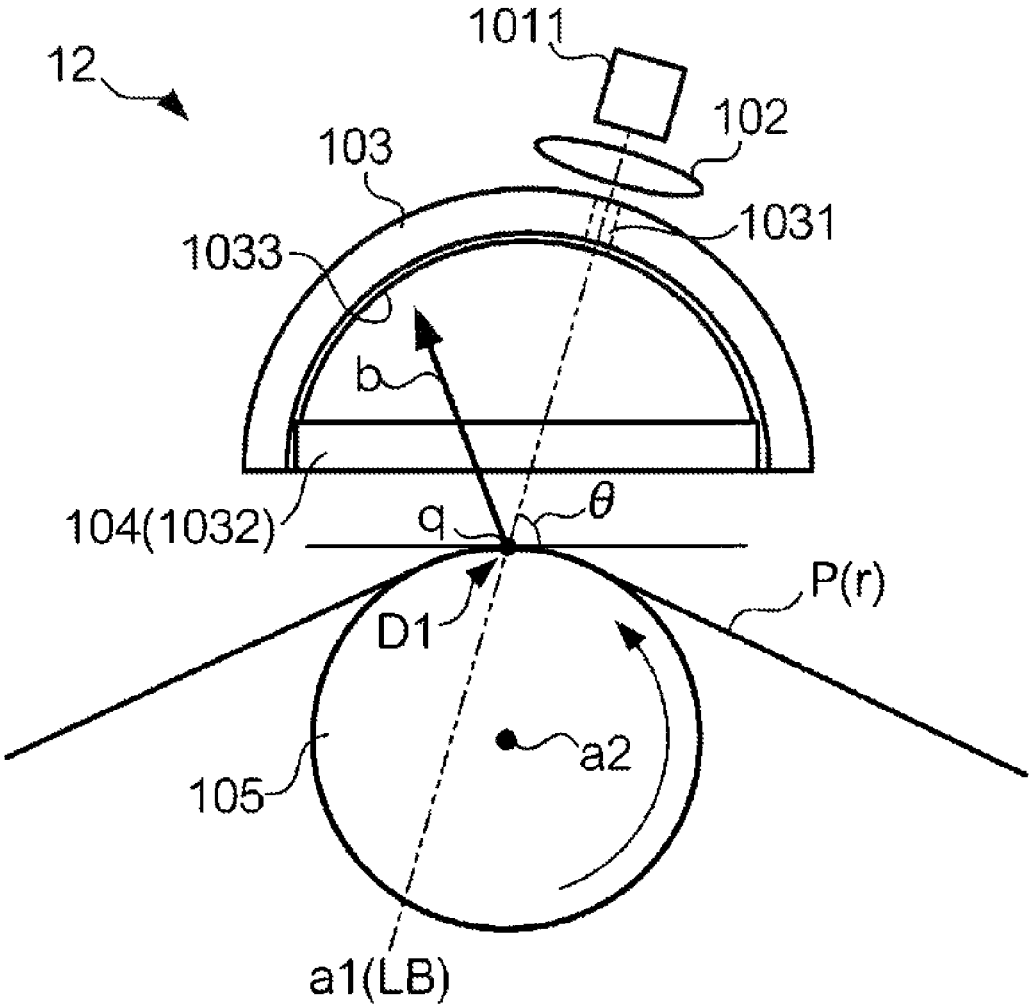
FIG. 7 is a schematic view when a fixing device according to a first modification is viewed from one side in a width direction.

FIG. 7 is a schematic view when a fixing device 12 according to the first modification is viewed from one side in a width direction. In the fixing device 12, the light source 1011 is disposed so that the angle θ is less than 90°. Moreover, similar to the fixing device 10 in the exemplary embodiment, the light source 1011 and the support roller 105 are disposed so that the light axis a1 does not intersect with the rotational axis a2. Moreover, in the example of FIG. 7, the point q is included in the irradiation region D1.

(2) Second Modification

The light source 1011 is not limited to a single light source in the transporting direction. Plural light sources 1011 may be lined up in the transporting direction. In this case, the light source 1011 and the support roller 105 are disposed so that the light axis a1 of each of the light sources 1011 lined up in the transporting direction does not intersect with the rotational axis a2.

Figure 8:
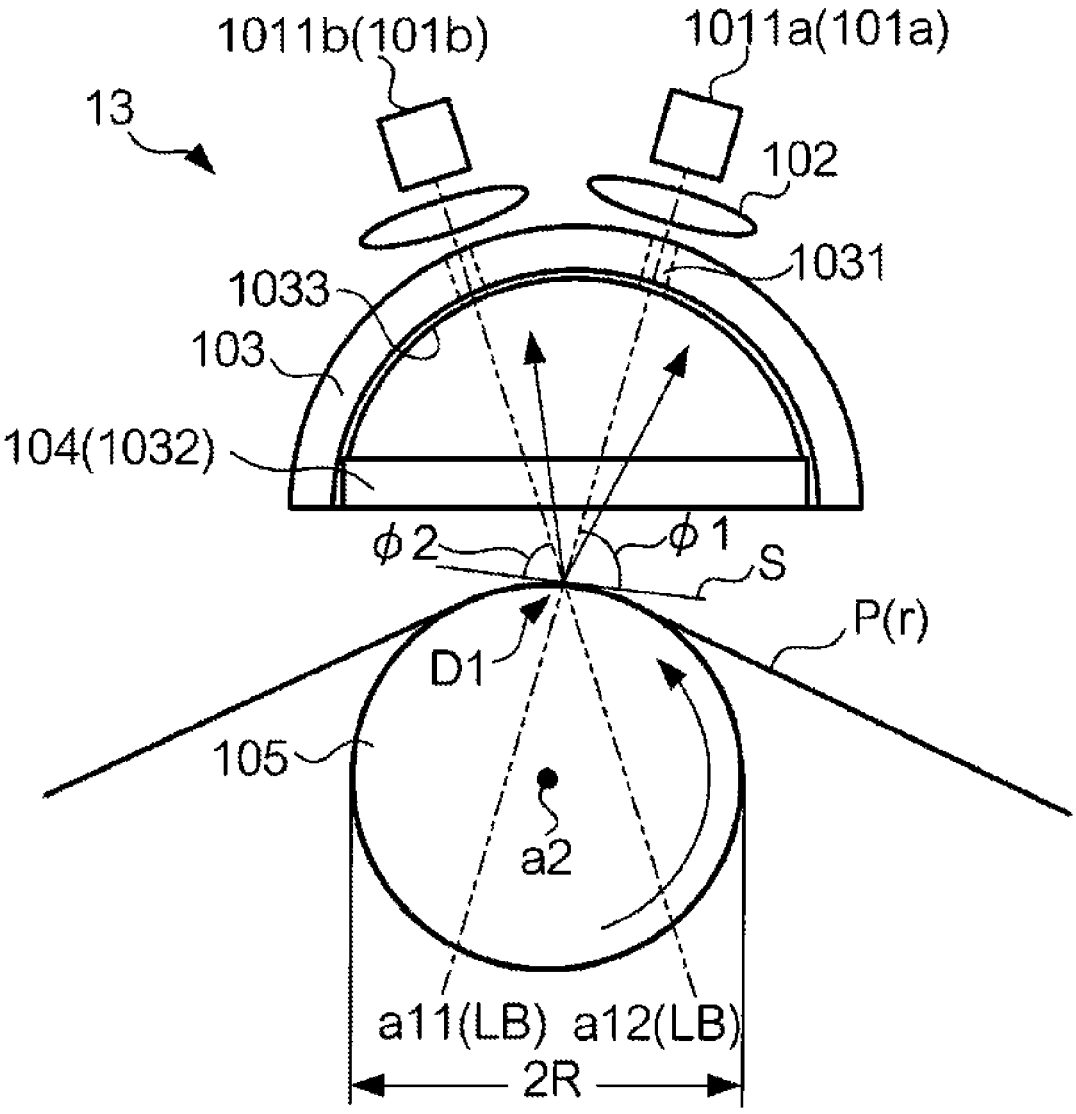
FIG. 8 is a schematic view when a fixing device according to a second modification is viewed from one side in a width direction.

FIG. 8 is a schematic view when a fixing device 13 according to the second modification is viewed from one side in a width direction. In the second modification, the fixing device 13 includes an irradiating portion 101*a* and an irradiating portion 101*b* (an example of a second irradiating portion).

The irradiating portion 101*a* and the irradiating portion 101*b* irradiate the laser light LB from the paper P side toward the support roller 105. The irradiating portion 101*a* includes plural light sources 1011*a*, and the irradiating portion 101*b* includes plural light sources 1011*b*. The light sources 1011*a* are light sources of the upstream side in the transporting direction, and the light sources 1011*b* are light sources of the downstream side in transporting direction. The light sources 1011*a* and the light sources 1001*b* are lined up at intervals g along the width direction. The light sources 1011*a* and the light sources 1011*b* are disposed so that a light axis a11 of each light source 1011*a* and a light axis a12 of each light source 1011*b* do not intersect with the rotational axis a2. Moreover, the light sources 1011*a* and the light sources 1011*b* are disposed so that the light axis a11 and the light axis a12 cross to each other at the irradiation region D1. In the second modification, for example, the distance between the light axis a11 and the light axis a12 and the rotational axis a2 is less than or equal to ¼ (R/2) of the diameter 2R of the support roller 105.

In addition, the light sources 1011*a* (or light sources 1011*b*) are disposed at a position in which the laser light LB that is mirror-reflected at the irradiation region D1 does not reach the light sources 1011*b* (or light source 1011*a*). Specifically, the light sources 1011*a* and the light sources 1011*b* are disposed so that an angle ϕ1 in which the light axis all of each light source 1011*a* is incident with respect to a surface S including the irradiation region D1 and an angle ϕ2 in which the light axis a12 of each light source 1011*b* is incident with respect to the surface S are different from each other.

(3) Third Modification

In the above-described exemplary embodiment, the example in which the support roller 105 which is an example of the rotating body supports the paper P is described. Here, if the rotating body contacts the paper P, the rotating body may not support the paper P. For example, the rotating body may contact the rear surface of the paper P that is transported in the height direction. As another example, the rotating body may contact the rear surface of the paper P from the upper side in the height direction with respect to the transport path r. In this case, the irradiating portion 101 irradiates the laser light LB to the front surface of the paper P from the lower side in the height direction with respect to the transport path r.

(4) Fourth Modification

The structures of the fixing device are not limited to those described in the exemplary embodiment. For example, the optical member 102 may diffuse the laser light LB in the width direction. In this case, a lens, in which the cross-section when viewed from the transporting direction is an approximately concave shape, is used for the optical member 102. As another example, a lens that diffuses the laser light LB in the width direction and a lens that converges the laser light LB in the transporting direction may be provided with respect to a single light source 1011. As still another example, a single optical member 102 that extends along the width direction may be provided so as to correspond to plural light sources 1011 that are lined up along the width direction.

(5) Fifth Modification

In the above-described exemplary embodiment, the rotating body (support roller 105) is exemplified as an example of the curved member. However, it is needless to say that the curved member is not limited to this. For example, an aspect, in which a recording medium is slidably transported on a fixed member having an approximately curved shape, is also included in the invention. Moreover, the center axis of the curved member indicates an axis that physically reflects the primary reflected light of the light irradiated on the surface of the curved member to the light source when the light axis of the laser light LB irradiated from the light source intersects with the center axis. For example, when the cross-section of the curved member is a column having complete roundness, the axis of the column corresponds to the center axis.

(6) Other Modifications

In the exemplary embodiment, the example where the paper P is the continuous paper is shown. However, the paper P may be one that is cut for each page according to the determined size. In the exemplary embodiment, an example of the image forming material is a toner. However, ink may be the image forming material. In this case, the ink is irradiated by light and dried, and thus, the image is fixed to the paper P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a curved member that supports a recording medium on which an image is formed by an image forming material that absorbs light and is fixed; and an irradiating portion that irradiates the curved member with light from the recording medium side, wherein (i) a light axis of the light is not perpendicular to a surface of the curved member, (ii) the light axis is substantially perpendicular to a tangential line extending from a middle point, in a transporting direction of the recording medium, of a region of the curved member supporting the recording medium, and (iii) the light axis does not intersect with the middle point.

2. The fixing device according to claim 1, wherein the curved member is a rotating body, and the irradiating portion irradiates the rotating body with light of which the light axis does not intersect with the rotational axis of the rotating body.

3. The fixing device according to claim 1, wherein a distance between a center axis of the curved member and the light axis is less than or equal to ¼ of a diameter of the curved member that perpendicularly crosses the light axis.

4. The fixing device according to claim 2, wherein a distance between a center axis of the curved member and the light axis is less than or equal to ¼ of a diameter of the curved member that perpendicularly crosses the light axis.

5. A fixing device comprising:

a curved member that supports a recording medium on which an image is formed by an image forming material that absorbs light and is fixed; and an irradiating portion that irradiates the curved member with a laser light from the recording medium side, wherein, when the laser light is mirror-reflected by a surface of the curved member, reflected light is not incident on the irradiating portion.

6. An image forming apparatus comprising:

a transfer portion that transfers an image to a recording medium, the image is formed by an image forming material that absorbs light and is fixed;

a transport member that transports the recording medium to which the image is transferred by the transfer portion;

a curved member that supports the recording medium having the image; and an irradiating portion that irradiates the curved member with light from the recording medium side, wherein (i) a light axis of the light is not perpendicular to a surface of the curved member, (ii) the light axis is substantially perpendicular to a tangential line extending from a middle point, in a transporting direction of the recording medium, of a region of the curved member supporting the recording medium, and (iii) the light axis does not intersect with the middle point.

* * * * *